US010023269B2

(12) United States Patent
Williamson

(10) Patent No.: US 10,023,269 B2
(45) Date of Patent: Jul. 17, 2018

(54) COLLAPSIBLE ANCHOR

(71) Applicant: Jay Williamson, Menomonie, WI (US)

(72) Inventor: Jay Williamson, Menomonie, WI (US)

( * ) Notice: Subject to any disclaimer, the term of this patent is extended or adjusted under 35 U.S.C. 154(b) by 20 days.

(21) Appl. No.: 14/558,879

(22) Filed: Dec. 3, 2014

(65) Prior Publication Data

US 2018/0065712 A1 Mar. 8, 2018

(51) Int. Cl.
*B63B 21/24* (2006.01)
*B63B 21/34* (2006.01)

(52) U.S. Cl.
CPC ..... *B63B 21/243* (2013.01); *B63B 21/34* (2013.01)

(58) Field of Classification Search
CPC ..... B63B 21/24; B63B 21/243; B63B 21/30; B63B 21/32; B63B 21/34; B63B 21/36; B63B 21/38; B63B 21/40; B63B 21/44; E02D 5/80; E02D 5/801; E02D 5/803
USPC ..... 114/294, 301–307; 52/155–165
See application file for complete search history.

(56) References Cited

U.S. PATENT DOCUMENTS 1,583,795 A * 5/1926 Pasturzak ..... A01K 95/00 114/303
2,526,214 A * 10/1950 Faraone ..... B63B 21/243 114/303
2,595,966 A * 5/1952 Majors ..... A01M 31/06 114/300
2,722,190 A * 11/1955 Simshauser ..... B63B 21/243 114/303
2,906,231 A 7/1957 Headington
3,111,106 A 11/1963 Burden
3,280,783 A 10/1966 Menning
3,285,218 A * 11/1966 Gilbertson ..... B63B 21/243 114/303
3,754,525 A * 8/1973 Leighty ..... B63B 21/30 114/303
4,700,652 A 10/1987 Pekny
(Continued)

FOREIGN PATENT DOCUMENTS

JP 2004074918 A 3/2004
RU 130289 U1 7/2013
(Continued)

OTHER PUBLICATIONS

International Search Report and Written Opinion dated Mar. 10, 2016 for corresponding International Application No. PCT/US2015/063718, filed Dec. 3, 2015.

*Primary Examiner* — Ajay Vasudeva
(74) *Attorney, Agent, or Firm* — Peter J. Ims; Westman, Champlin & Koehler, P.A.

(57) ABSTRACT

An apparatus includes an elongated, hollow member; a cap; and a pair of arms. The elongated, hollow member has a first closed end and a second open end, wherein the second open end includes a plurality of slots therein. The cap is configured for detachable attachment to the second open end. The pair of arms is configured to fit into the elongated, hollow member in a first configuration. The pair of arms is configured for insertion into the plurality of slots in a second configuration, wherein one of the pair of arms is oriented substantially orthogonally to the other of the pair of arms. A method of using an anchor includes inserting a pair of arms into the elongated, hollow member; and closing the second open end with a cap configured for detachable attachment to the second open end.

10 Claims, 6 Drawing Sheets

(56) References Cited

U.S. PATENT DOCUMENTS

| | | | |
|---|---|---|---|
| 5,095,842 | A | 3/1992 | Soules |
| 6,038,996 | A | 3/2000 | Giles |
| 6,079,761 | A | 6/2000 | Sadeck |

FOREIGN PATENT DOCUMENTS

| | | | |
|---|---|---|---|
| RU | 2499723 | C1 | 11/2013 |
| SU | 1119915 | A1 | 10/1984 |

* cited by examiner

COLLAPSIBLE ANCHOR

BACKGROUND

An anchor is conventionally used with a water craft to maintain the water craft in a desired position on a body of water. An anchor typically consists of a shank and one or more arms extending outwardly from an end of the shank with flukes at distal ends of the arms. The flukes are shaped to engage a bed of the body of water so that the anchor is maintained in the desired location by a combination of a weight of the anchor and the shape of the flukes. Typically, a rope or cable is attached to the opposite end of the shank to connect the anchor to the water craft.

A problem with conventional anchor is that the outwardly extending arms with flukes typically have a shape that is cumbersome to handle, transport and store. Further a weight of the anchors make it difficult to transport over land, such as when portaging a canoe from one body of water to another body of water.

SUMMARY

In one aspect, an apparatus comprises an elongated, hollow member; a cap; and a pair of arms. The elongated, hollow member has a first closed end and a second open end, wherein the second open end comprises a plurality of slots therein. The cap is configured for detachable attachment to the second open end. The pair of arms is configured to fit within an interior cavity of the elongated, hollow member in a first configuration. The pair of arms is configured for insertion into the plurality of slots in a second configuration, wherein one of the pair of arms is oriented substantially orthogonally to the other of the pair of arms.

In another aspect, a method of transporting or storing an anchor comprises providing an elongated, hollow member having a first closed end and a second open end, wherein the second open end comprises a plurality of slots therein; inserting a pair of arms into the elongated, hollow member; and closing the second open end with a cap configured for detachable attachment to the second open end.

This summary is provided to introduce concepts in simplified form that are further described below in the Detailed Description. This summary is not intended to identify key features or essential features of the disclosed or claimed subject matter and is not intended to describe each disclosed embodiment or every implementation of the disclosed or claimed subject matter. Specifically, features disclosed herein with respect to one embodiment may be equally applicable to another. Further, this summary is not intended to be used as an aid in determining the scope of the claimed subject matter. Many other novel advantages, features, and relationships will become apparent as this description proceeds. The figures and the description that follow more particularly exemplify illustrative embodiments.

BRIEF DESCRIPTION OF THE DRAWINGS

The disclosed subject matter will be further explained with reference to the attached figures, wherein like structure or system elements are referred to by like reference numerals throughout the several views.

While the above-identified figures set forth one or more embodiments of the disclosed subject matter, other embodiments are also contemplated, as noted in the disclosure. In all cases, this disclosure presents the disclosed subject matter by way of representation and not limitation. It should be understood that numerous other modifications and embodiments can be devised by those skilled in the art which fall within the scope and spirit of the principles of this disclosure.

The figures may not be drawn to scale. In particular, some features may be enlarged relative to other features for clarity. Moreover, where terms such as above, below, over, under, top, bottom, side, right, left, etc., are used, it is to be understood that they are used only for ease of understanding the description. It is contemplated that structures may be oriented otherwise.

DETAILED DESCRIPTION

Figure 1:
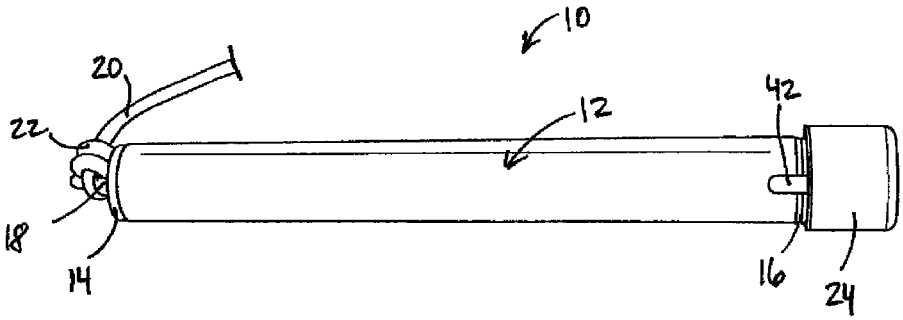
FIG. 1 is a side elevation view of an exemplary embodiment of a collapsible anchor apparatus of the present disclosure, wherein some components of the apparatus are not visible, as they are contained within the pipe.

FIGS. 1-6 illustrate an exemplary embodiment of a collapsible anchor 10 of the present disclosure. FIG. 1 shows the collapsible anchor 10 in a fully stowed configuration that is particularly suitable for storage and transport due to its compact size and smooth shape.

Figure 2:
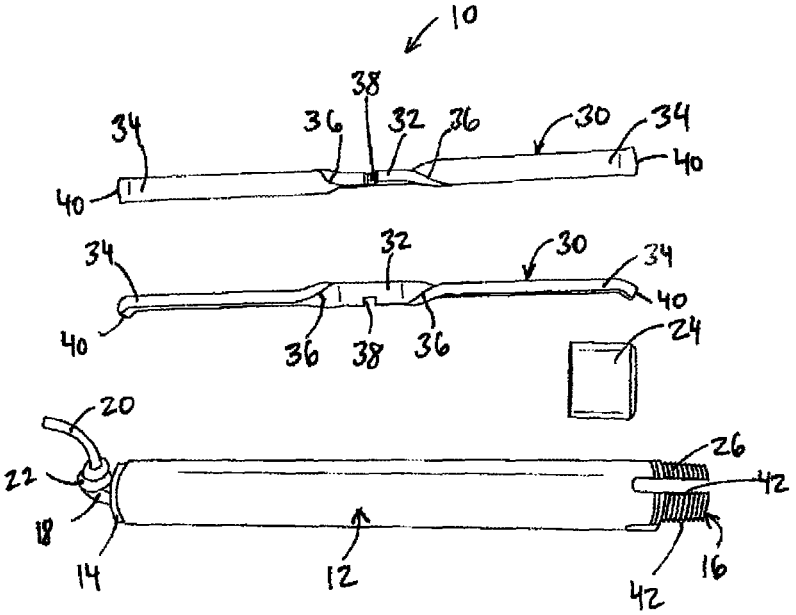
FIG. 2 is a view of the apparatus of FIG. 1, wherein all components of the apparatus are visible.
Figure 3:
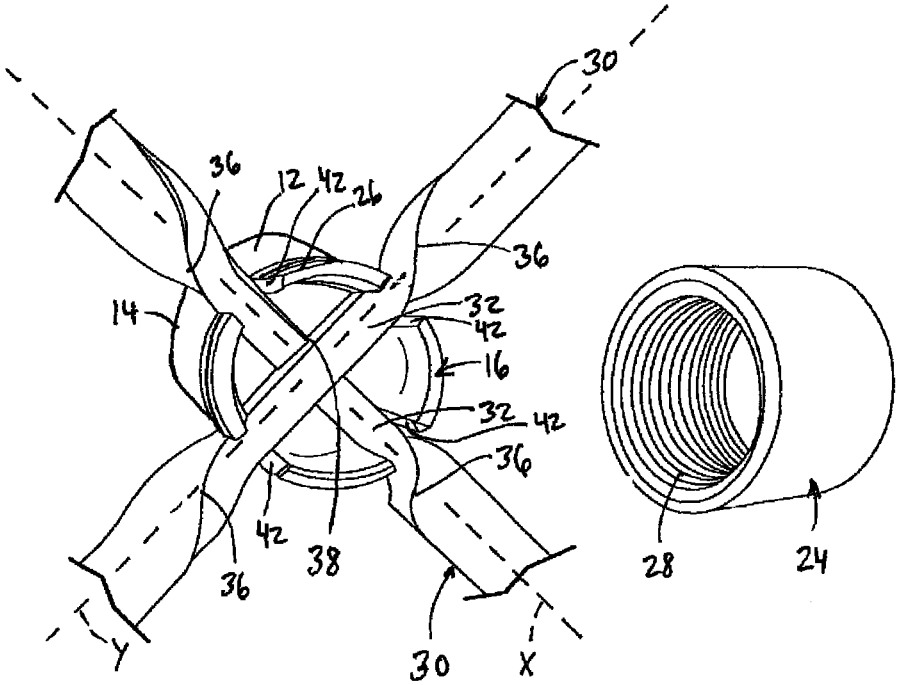
FIG. 3 is an end perspective view of a portion of the components of the collapsible anchor.

As shown in FIGS. 1-3, pipe 12 is substantially closed at first end 14 and open at second end 16. While a cylindrical pipe 12 is illustrated, it is contemplated that pipe 12 may be a hollow, elongated structure with any cross-sectional shape. As shown in FIGS. 1, 2, 5 and 6, first end 14 includes attachment device 18 positioned proximate thereto. Attachment device 18 may be a structure such as a loop, eyelet or aperture for the connection of rope 20. While a rope 20 is discussed in the present disclosure, it is contemplated that the attachment of collapsible anchor 10 to a water craft can also be accomplished by a cable, wire or other similar device.

In an exemplary embodiment, rope 20 is connected to collapsible anchor 10 by a knot 22 formed in the rope 20 about attachment device 18. While only a short portion of rope 20 is illustrated in the drawing figures, it is to be understood that another end of rope 20 is connected to a water craft. While a knot 22 is illustrated, it is contemplated that other securing devices may also be utilized such as a carabiner, a snap ring, a threaded ring or an elongated member that is sized to engage and not pass through the engagement device.

As shown in FIGS. 1 and 2, cap 24 is detachably attached to second end 16 of pipe 12. In an exemplary embodiment, this attachment is accomplished by the engagement of external threads 26 on second end 16 with internal threads 28 on cap 24 (see FIG. 3). However, other forms of detachable engagement can also be used, for example a snap-fit, a latching mechanism or other rotatable closures.

Figure 4:
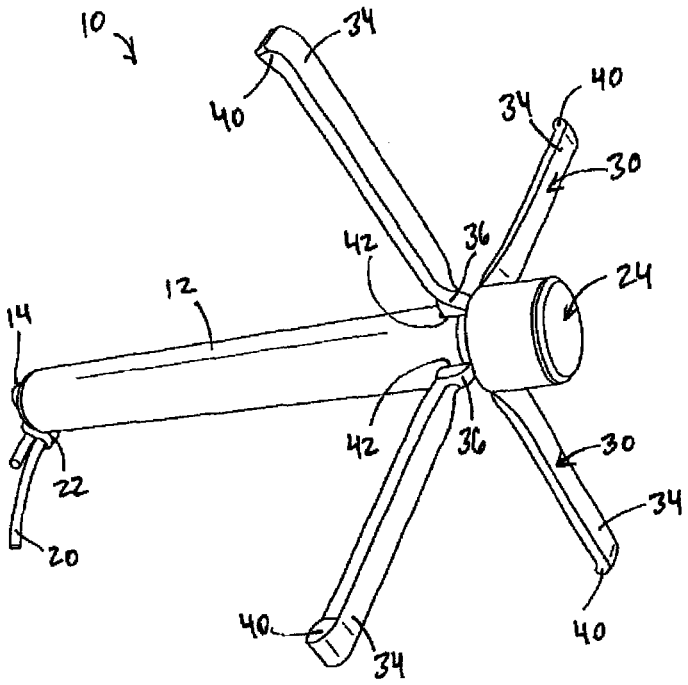
FIG. 4 is a first end perspective view of an assembled anchor of the present disclosure.
Figure 5:
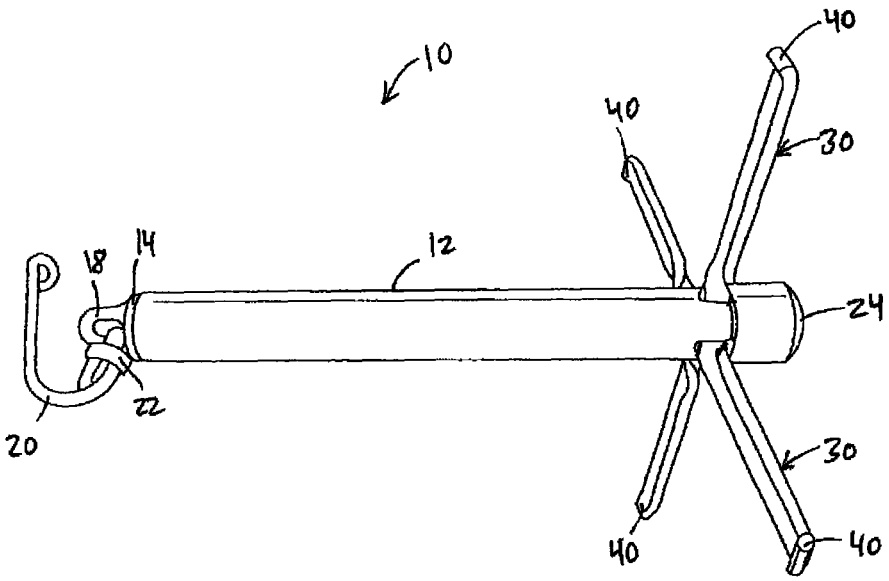
FIG. 5 is a side perspective view of the collapsible anchor in an assembled configuration.

FIG. 2 also shows two arms 30 which in an exemplary embodiment are identical to each other but need not be. Each arm 30 includes a central portion 32 that is oriented substantially orthogonal to an orientation of each of ends 34. In an exemplary embodiment, this offset of about 90 degrees is accomplished by a twist 36 in arm 30 on each side of central portion 32. Central portion 32 includes notch 38 positioned proximate a longitudinal midpoint of arm 30. Each end 34 includes a fluke or hook 40 formed therein. As shown in FIG. 3, assembly of collapsible anchor 10 includes orientation of the arms 40 so that notches 38 face each other for pressed engagement together in a configuration where the two arms 30 are substantially orthogonal to each other. The arm 30 thus assembled are then inserted into slots 42 of end 16 of pipe 12. Referring also to FIGS. 4 and 5, when the arms 30 are seated into the slots 42, the arms 30 are further aligned with each other in a substantially planar orientation, wherein the first and second top edges of the central portions 32 of the two arms 30 are substantially planar where the cap 24 meets the top edges of the central portions 32 of the two arms 30, and wherein the first and second bottom edges of the central portions 32 of the two arms 30 are substantially planar where the bottom edges of the central portions 32 of the two arms 30 meet the ends of the substantially same length slots 42.

The twist 36 in each of arms 30 prevents the arms 30 from sliding along the x and y axes of the anchor 10. With arms 30 seated at the base of slots 42, cap 24 is threaded back onto end 16 to retain the assembled arms 30 in position. In an exemplary assembly, flukes or hooks 40 are oriented to face toward first closed end 14 of pipe 12.

Figure 6:
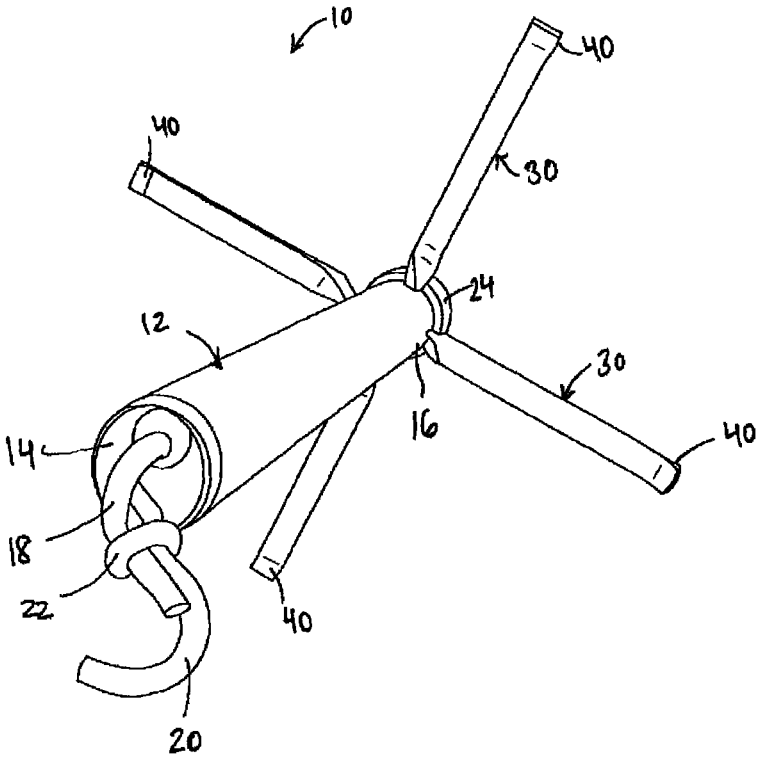
FIG. 6 is a second end perspective view of the assembled anchor.

To use the anchor 10, user may lower the collapsible anchor 10 into a body of water by rope 20, as depicted in FIG. 6. One or two of flukes or hooks 40 on the arms 30 are configured to engage a bed of the body of water. The flukes or hooks 40 may also engage rocks or other debris or structures on the bed of the body of water. Thus, the collapsible anchor 10 engages with the bed to keep the water craft attached thereto in a desired position on the water's surface.

When the user wishes to move from one location to another location, he or she pulls up collapsible anchor 10 using rope 20. Once the anchor is in the water craft, cap 24 may be unthreaded to allow for the release of arms 30 from slots 42. The arms 30 can then be disengaged from each other by disassembling the engagement of notches 38 of the two arms 30. The two arms 30 can then be inserted into pipe 12 through the opening at end 16. Cap 24 is rethreaded on to end 16 to contain and retain the arms 30 within pipe 12. The rope 20 can be detached from the water craft and the knot 22 can be undone such that the rope 20 can be stored in the pipe 12. Alternatively, the rope 20 can also be inserted into pipe 12 so that one end remains secured at knot 22 while the other end resides inside pipe 12, with an intermediate portion of rope 20 passing through slots 42 to prevent interference of the cooperation of cap 24 on end 16 such that the arms 30 and a majority of the rope 20 are securely stored within the pipe 12.

Thus, the present disclosure describes a collapsible anchor 10 that is stowable in a self-contained apparatus that is compact. Moreover, collapsible anchor 10 has a form that is easy to handle in that there are no sharp edges exposed or protruding members in the configuration shown in FIG. 1. The anchor can be easily assembled and disassembled without the use of tools, forming a lightweight yet effective anchor that is especially suitable for small water craft.

In one example, pipe 12 may have a diameter of about 1.5 inches. This size is especially suitable for use with lightweight, non-motorized water craft such as kayaks or canoes, for example. In another embodiment, pipe 12 may have a diameter of about 2.5 inches, allowing for the containment of larger arms 30. This size may be especially suitable for smaller dinghies and fishing boats, for example as the larger pipe 12 increases the weight of the anchor 10. It is contemplated that collapsible anchor 10 may be provided in a variety of sizes for a water craft of varying mass. Moreover, an exemplary illustration of relative sizes of components of an embodiment of collapsible anchor 10 is shown. However, it is contemplated that other sizes of arms 30, for example, may be used with a particular pipe 12, as long as the arms 30 fit entirely within pipe 12 when disassembled and allow the cap 24 to close the second end 16.

The collapsible anchor 10 can be made of many different materials including metals and plastics; however, it is contemplated that non-corrosive metals such as stainless steel and aluminum may be particularly suitable.

Although the subject of this disclosure has been described with reference to several embodiments, workers skilled in the art will recognize that changes may be made in form and detail without departing from the spirit and scope of the disclosure. In addition, any feature disclosed with respect to one embodiment may be incorporated in another embodiment, and vice-versa.

What is claimed is:

1. An apparatus comprising:

an elongated, hollow member having a first closed end and a second open end, wherein the second open end comprises a plurality of slots therein wherein the elongated member has a threaded outer surface proximate the second open end;

a cap having a threaded inner surface wherein the cap is configured to be threadably attached to the elongated, hollow member proximate the second open end; and a first arm comprising a first middle portion having a first height from a first top edge to a first bottom edge and a first notch extending from the bottom edge and into the middle portion;

a second arm comprising a second middle portion having a second height from a second top edge to a second bottom edge, wherein the second arm has a second notch extending from the second top edge and into the middle portion;

wherein the first and second arms are configured to fit within the elongated, hollow member in a first configuration where the first and second arms are detached from each other; and wherein the pair of arms is configured for insertion into the plurality of slots in a second configuration, wherein the first and second arms are secured substantially orthogonally to each other by aligning the first and second notches and positioning the respective opposing arm into either the first notch or the second notch, wherein the first and second top edges are substantially planar with each other and the first and second bottom edges are substantially planar with each other when the cap threadably engages the threaded outer surface of the elongated, hollow member such that the pair of arms are frictionally secured between an upper edge of each of the plurality of slots and a top edge of the cap.

2. The apparatus of claim 1 further comprising an attachment device positioned proximate the first closed end.

3. The apparatus of claim 1 wherein the first and second notches are located substantially at a longitudinal midpoint of the first and second arms, respectively.

4. The apparatus of claim 1 wherein the first and second arms each comprises the middle portion and first and second end portions extending from the middle portion, and wherein the middle portion is oriented substantially orthogonally with respect to each of the first and second end portions.

5. The apparatus of claim 4 wherein the first and second arms each comprises a twist within the middle portion and between each of the first and second end portions.

6. The apparatus of claim 1 wherein of the first and second arms each comprises a hook proximate an end thereof.

7. A method of using an anchor comprising:

providing an elongated, hollow member having a first closed end and a second open end, wherein the second open end comprises a plurality of slots therein;

inserting a pair of arms into the elongated, hollow member having a threaded outer surface proximate the second open end;

threadably securing a cap to the second open end;

opening the second open end by threadably disengaging the cap therefrom;

removing the pair of arms;

inserting each of the pair of arms into the plurality of slots so that one of the pair of arms is oriented substantially orthogonally to the other of the pair of arms wherein the pair of arms include middle portions having upper and lower surfaces; and threadably reattaching the cap onto the second open end such that the arms are frictionally secured between an upper surface of the plurality of slots and an upper edge of the cap wherein the upper surfaces are substantially planar with each other and the lower surfaces are substantially planar with each other.

8. The method of claim 7 wherein each of the pair of arms comprises a notch proximate a longitudinal midpoint thereof, the method further comprising assembling the pair arms together in a substantially orthogonal assembly by engaging their respective notches together before inserting each of the pair of arms into the plurality of slots.

9. The method of claim 7 wherein each of the pair of arms comprises a hook proximate an end thereof, the method further comprising orienting the hook to face toward the first closed end before inserting each of the pair of arms into the plurality of slots.

10. The method of claim 7 further comprising attaching a rope to an attachment device positioned proximate the first closed end.

* * * * *